US006227814B1

(12) United States Patent
Yokomachi et al.

(10) Patent No.: US 6,227,814 B1
(45) Date of Patent: May 8, 2001

(54) RECIPROCATING TYPE REFRIGERANT COMPRESSOR WITH AN IMPROVED INTERNAL SEALING UNIT

(75) Inventors: Naoya Yokomachi; Kazuo Murakami; Tatsuya Koide, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/318,855

(22) Filed: May 26, 1999

(30) Foreign Application Priority Data

May 29, 1998 (JP) ..... 10-149898

(51) Int. Cl.[7] ..... F04B 1/12; F04B 27/08; F04B 1/26

(52) U.S. Cl. ..... 417/269; 417/222.1

(58) Field of Search ..... 417/269, 222.1; 74/22, 55; 91/472; 92/12.1

(56) References Cited

U.S. PATENT DOCUMENTS 4,011,029 * 3/1977 Shimizu ..... 417/269
4,155,683 * 5/1979 Mochizuki et al. ..... 417/269
4,283,166 * 8/1981 Hiraga ..... 417/269
4,416,190 * 11/1983 Ishizuka ..... 92/71
4,428,718 * 1/1984 Skinner ..... 417/222.2
4,688,997 * 8/1987 Suzuki et al. ..... 417/222.2
5,214,925 * 6/1993 Hoy et al. ..... 62/50.6
5,709,535 * 1/1998 Enomoto et al. ..... 417/269
5,842,836 * 12/1998 Tarutani et al. ..... 417/269
5,857,839 * 1/1999 Fisher et al. ..... 417/269
5,934,170 * 8/1999 Morita ..... 92/12.2
6,012,905 * 1/2000 Takashima et al. ..... 417/222.1

* cited by examiner

*Primary Examiner*—Teresa Walberg
*Assistant Examiner*—Daniel Robinson
(74) *Attorney, Agent, or Firm*—Woodcock Washburn Kurtz Mackiewicz & Norris LLP

(57) ABSTRACT

A reciprocating refrigerant compressor having a cylinder block provided with a plurality of cylinder bores in which a refrigerant gas sucked from a suction chamber is compressed to be subsequently discharged into a discharge chamber, a valve plate having suction ports through which the refrigerant gas is sucked into the respective cylinder bores and discharge ports through which the compressed refrigerant gas is discharged, a suction valve attached to one end face of the valve plate, a discharge valve attached to the other end face of the valve plate, a housing assembly attached to the cylinder block and having the suction and discharge chambers, and a sealing unit arranged in one of boundaries between the end face of the cylinder block and the suction valve, and between the suction valve and the valve plate to provide an annular sealing portions around each of the bore ends of the plurality of cylinder bores. The typical sealing unit is formed of a metallic base plate and elastic rubber membranes attached to the opposite faces of the metallic base plate.

9 Claims, 5 Drawing Sheets

RECIPROCATING TYPE REFRIGERANT COMPRESSOR WITH AN IMPROVED INTERNAL SEALING UNIT

BACKGROUND OF THE INVENTION

1. Field of the Invention

The present invention relates generally to a reciprocating type refrigerant compressor improved so as to prevent leakage of a compressed refrigerant from the cylinder bores in which compression of the refrigerant is carried out by the reciprocation of pistons. More particularly, the present invention relates to an improved internal sealing unit interposed between an end of a cylinder block and a valve plate assembly of a reciprocating type refrigerant compressor in order to tightly seal the periphery of each of a plurality of cylinder bores in which respective pistons reciprocate to suck a refrigerant from a suction chamber, compress the refrigerant, and discharge the compressed refrigerant into a discharge chamber. The reciprocating type refrigerant compressor according to the present invention is intended to be used as a refrigerant compressor incorporated in a vehicle climate control system.

2. Description of the Related Art

U.S. Pat. No. 4,688,997 to Suzuki et al. discloses one of the typical reciprocating refrigerant compressors adapted for use in a vehicle climate control system. The reciprocating refrigerant compressor includes a cylinder block having formed therein a plurality of parallel cylinder bores arranged around an axis of rotation of a drive shaft rotatably supported by the cylinder block and a housing assembly closing the opposite ends of the cylinder block, a valve plate having bored therein a plurality of suction ports and a plurality of discharge ports arranged to open into the respective cylinder bores, a suction chamber, a discharge chamber and, a crank chamber which are defined in the housing assembly, a suction valve interposed between one end of the cylinder block and the valve plate, a discharge valve interposed between the valve plate and the housing assembly, and a plurality of single-headed pistons reciprocating in the cylinder bores for the compression of a refrigerant sucked from the suction chamber and for the discharge of the compressed refrigerant into the discharge chamber. Namely, in the reciprocating refrigerant compressor, the plurality of pistons reciprocate in the cylinder bores in response to the rotation of a cam plate and the drive shaft within the crank chamber and, accordingly, the refrigerant at low temperature and pressure which has entered from an external refrigerating circuit into the suction chamber is sucked into the respective cylinder bores via the suction ports to be compressed by the pistons in the compression chambers formed in the respective cylinder bores. The compressed refrigerant is discharged as the refrigerant gas at high temperature and pressure by the pistons from the compression chambers into the discharge chamber via the discharge ports. The compressed refrigerant is further delivered from the discharge chamber into the external refrigerating circuit of the climate control system.

When the refrigerant is compressed by the pistons within the compression chambers in the respective cylinder bores, the refrigerant at high pressure should be discharged from the compression chambers into only the discharge chamber while being prevented from leaking into a suction pressure area or an exterior of the compressor via an end face area of the cylinder block surrounding the respective cylinder bores. The leakage of the compressed refrigerant reduces the amount of the compressed refrigerant to be used with the climate control system, and therefore, the compressing performance of the refrigerant compressor decreases. Thus, the end of the cylinder block must be appropriately sealed.

The sealing of the cylinder block end and, particularly, the end face area surrounding the respective cylinder bores of the cylinder block, to prevent the leakage of the compressed refrigerant acquires a great importance to the reciprocating refrigerant compressors used with a supercritical-cycle-refrigerating system in which a closed refrigerant-circulation path thereof includes a high-pressure path through which the refrigerant under a high discharge pressure, more specifically, under an supercritical pressure flows.

In the refrigerant compressor incorporated in the supercritical-cycle refrigerating system, the gas of the refrigerant is compressed to have a pressure high above a critical pressure peculiar to the refrigerant. For example, when a carbon dioxide of which the critical pressure is 7.35 MPa is used as a refrigerant, the compressor compresses the refrigerant to a pressure of approximately 10 MPa.

On the other hand, when a fluorinated hydrocarbon gas is used as the refrigerant, and when the refrigerant compressor is incorporated in a refrigerating system operated under a condition such that a discharge pressure and a suction pressure of the refrigerant gas are always kept below a critical pressure of the refrigerant gas (this type of refrigerating system will be hereinafter referred to as a subcritical-cycle-type refrigerating system), the discharge pressure of the refrigerant discharged from the compression chambers of the compressor is approximately 1 through 3 MPa.

Therefore, it will be understood that the discharge pressure of the compressor incorporated in the supercritical-cycle-type refrigerating system is much higher than that of the compressor incorporated in the subcritical-cycle-type refrigerating system.

Accordingly, the sealing of the end face area of the cylinder block around the respective cylinder bores is very critical to the reciprocating refrigerant compressor which is used with the supercritical-cycle-type refrigerating system, in order to prevent leakage of the compressed refrigerant from the cylinder bores into the suction pressure region in the compressor or the exterior of the compressor, via a boundary between the end face area of the cylinder block around the cylinder bores and the confronting face of the valve plate.

SUMMARY OF THE INVENTION

An object of the present invention is to provide a reciprocating refrigerant compressor with a sealing unit capable of surely preventing leakage of the refrigerant at a high pressure from respective cylinder bores into non-desired region inside or outside the compressor.

Another object of the present invention is to provide a sealing unit suitable for sealing an end face of a cylinder block at an area surrounding bore ends of the cylinder bores of a reciprocating refrigerant compressor, which is used for compressing a refrigerant to a pressure far above a critical pressure of the refrigerant, and for preventing leakage of the compressed refrigerant from the cylinder bores into non-desired region inside or outside the compressor such as the suction pressure area or the exterior of the compressor to thereby prevent a reduction in the compressing performance of the compressor.

A further object of the present invention is to provide a reciprocating refrigerant compressor provided with a sealing unit, which permits the compressor to employ a carbon dioxide as a refrigerant and to be used with a supercritical-cycle-type refrigerating system.

In accordance with the present invention, there is provided a reciprocating refrigerant compressor which comprises:

- a cylinder block having formed therein a plurality of cylinder bores arranged to be parallel with one another around an axis extending between opposite ends of the cylinder block;
- a valve plate arranged adjacent to the cylinder block and having bored therein a plurality of suction ports and a plurality of discharge ports which are respectively arranged to be in registration with the cylinder bores;
- a housing assembly assembled to the cylinder block to close the opposite ends of the cylinder block and defining a suction chamber, a discharge chamber, and a crank chamber;
- a suction valve interposed between one of the opposite ends of the cylinder block and the valve plate;
- a discharge valve interposed between the valve plate and an end of the housing assembly;
- a plurality of pistons arranged to be reciprocated in the plurality of cylinder bores for the compression of a refrigerant sucked from the suction chamber and for the discharge of the compressed refrigerant into the discharge chamber;
- a sealing unit held in at least one of boundaries between one of the opposite ends of the cylinder block and the suction valve and between the suction valve and the valve plate, the sealing unit comprising a plurality of annularly extending sealing portions arranged to surround respective bore ends of the plurality of cylinder bores.

Since the sealing unit is held in either the boundary between the end of the cylinder block and the suction valve or that between the suction valve and the valve plate in such a manner that the respective annularly extending sealing portions thereof surrounding the bore ends of the cylinder bores are subjected to compression to keep a press-contact with the confronting faces, the respective bore ends of the cylinder bores are tightly sealed so as to ensure the discharge of all of the compressed refrigerant at a high pressure, from each cylinder bore into the discharge chamber, without leakage. Accordingly, a reduction in the compressing performance of the reciprocating refrigerant compressor due to leakage of the compressed refrigerant via the bore ends of the plurality of cylinder bores can be surely prevented.

Preferably, the sealing unit includes a metallic base plate having opposite faces thereof, and a gasket element formed by elastic rubber membranes attached to the opposite faces of the metallic base plate, the metallic base plate having a plurality of annularly extending convexo-concave portions in the form of an annular bead portion, respectively, which form the plurality of annularly extending sealing portions.

Alternately, the sealing unit may comprise a plurality of o-ring elements arranged around each of the respective bore ends of the plurality of cylinder bores.

The above-described reciprocating refrigerant compressor according to the present invention may discharge the refrigerant by compressing it to a super-critical pressure. Then, the refrigerant may be comprised of carbon dioxide.

BRIEF DESCRIPTION OF THE DRAWINGS

The above and other objects, features, and advantages of the present invention will be made more apparent from the ensuing description of preferred embodiments thereof with reference to the accompanying drawings wherein.

DESCRIPTION OF THE PREFERRED EMBODIMENTS (The First Embodiment)

Figure 1:
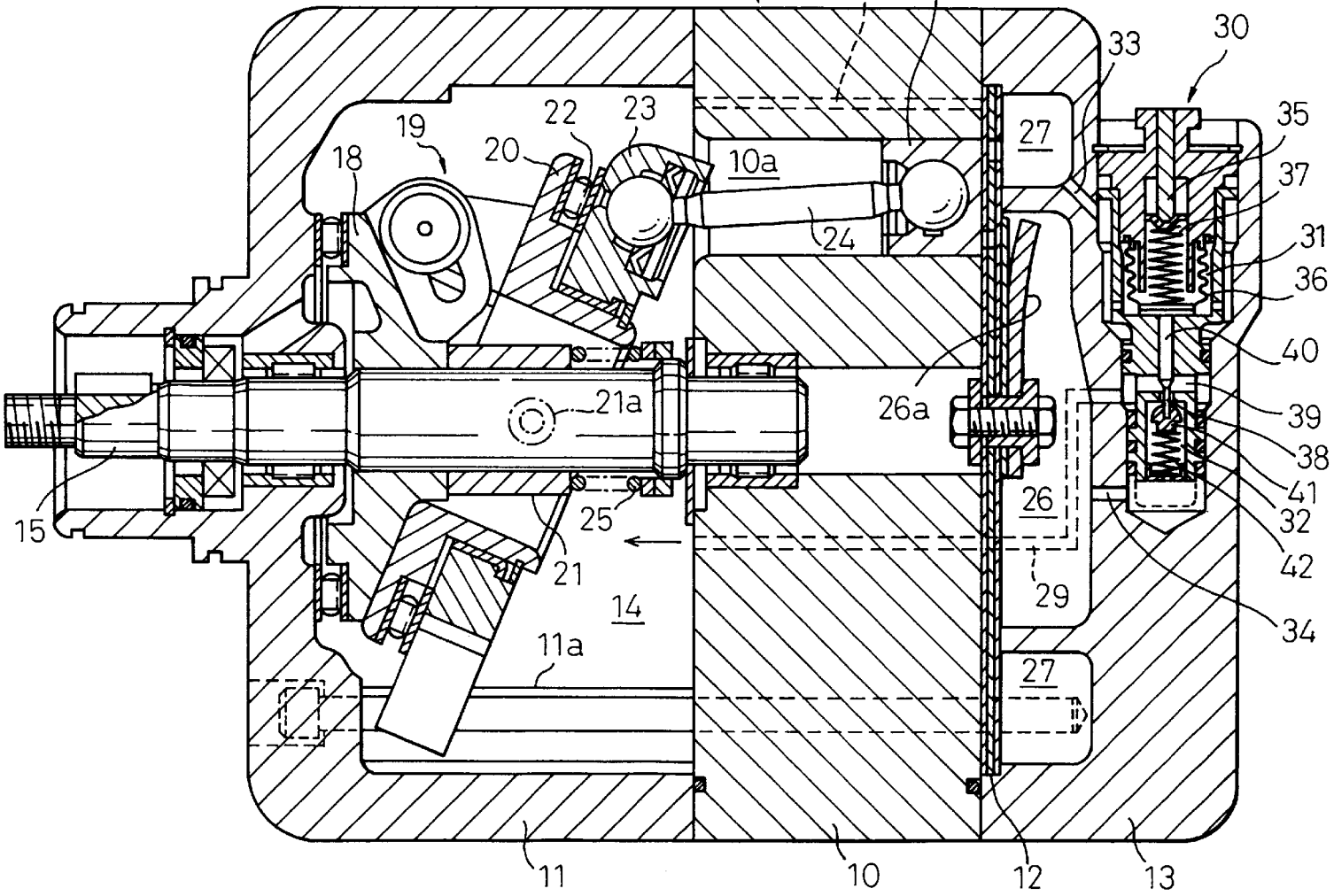
FIG. 1 is a reciprocating refrigerant compressor according to a first embodiment of the present invention, in which an improved sealing unit is assembled.

Referring to FIG. 1, a reciprocating refrigerant compressor 1 is formed to be incorporated in a refrigerating system of a vehicle climate control system, especially in a supercritical-cycle-type refrigerating system of the vehicle climate control system. Namely, the supercritical-cycle-type refrigerating system is constructed by including the refrigerant compressor 1, a gas cooler (not shown) functioning as a heat-radiation type heat exchanger, an expansion valve (not shown) functioning as a gas-throttling means, an evaporator functioning as heat-absorption type heat exchanger, and an accumulator functioning as a liquid-gas separator which are interconnected in series to form a closed fluid circuit. The supercritical-cycle-type refrigerating system operates in such a manner that the discharge pressure of the refrigerant delivered from the refrigerant compressor 1, i.e., the pressure prevailing in a high-pressure circuit side of the closed fluid circuit of the refrigerating system is always kept at a supercritical pressure of the refrigerant flowing through the closed fluid circuit. The refrigerant employed for the described supercritical-cycle-refrigerating system is preferably carbon dioxide ($CO_2$). The refrigerant may alternately be one of ethylene ($C_2H_4$), Diborane ($B_2H_6$) ethane ($CH_3CH_3$), and a nitrogen oxide.

The reciprocating refrigerant compressor 1 includes a cylinder block 10 having an axially front and rear ends opposed to one another. The front end of the cylinder block 10 is closed by a front housing 11 which is air-tightly connected to the cylinder block 10. The rear end of the cylinder block 10 is closed by a rear housing 13 via a valve plate 12. The rear housing 13 is air-tightly connected to the cylinder block 10. The front housing 11 and the cylinder block 10 define therebetween a crank chamber 14 in which a drive shaft 15 extends axially. The drive shaft 15 is rotatably supported by the front housing 11 and the cylinder block 10 via a pair of radial bearings and a shaft sealing unit arranged adjacent to an extreme end of the drive shaft 15 which extends through a central boss portion of the front housing 11. The outer extreme end of the drive shaft 15 is connectable to an armature of a solenoid clutch (not shown)

to receive a drive power from an external drive power source. The other end of the drive shaft 15 extends into a central bore of the cylinder block 10, and a thrust bearing and a disc spring (both are not shown) are arranged in the central bore between the other end of the drive shaft 15 and the valve plate 12. The cylinder block 10 is provided with a plurality of (six) axial cylinder bores 10*a* arranged around an axis of rotation of the drive shaft 15 for slidably receiving single-headed pistons 16.

A rotor element 18 is mounted on the drive shaft 15 at a position adjacent to an inner end face of the front housing 11 within the crank chamber 14. The rotor element 18 is axially supported by the inner end face of the front housing 11 via a thrust bearing, and can rotate together with the drive shaft 15. The rotor element 18 has a rearwardly extending portion which forms a hinge mechanism 19 by which the rotor element 18 is connected to a rotatable swash plate 20 mounted around the drive shaft 15. Therefore, the swash plate 20 can rotate together with the rotor element 18. Within the crank chamber 14, a sleeve element 21 is slidably mounted on the drive shaft 15 and has a pair of lateral pivots 21*a*, 21*a* about which the swash plate 20 is turnably engaged to be able to change an angle of inclination thereof. The swash plate 20 supports thereon a non-rotatable wobble plate 23 via a thrust bearing 22, and the wobble plate 23 is engaged at its lower portion with a rotation preventing pin (not shown) which is arranged to be axially slidable in a guide recess 11*a* formed in a bottom portion of the front housing 11. Thus, the non-rotatable wobble plate 23 can be prevented from rotating even when the swash plate 20 is rotating, and is permitted only to turn about the pivots 21*a*, 21*a*. The wobble plate 23 is operatively engaged with the single-headed pistons 16 via connecting rods 24, and thus the respective pistons 16 can reciprocate in the corresponding cylinder bores 10*a* at a stroke determined by an angle of inclination of the wobble plate 23 with respect to a plane perpendicular to the axis of rotation of the drive shaft 15.

A coil spring 25 is arranged between an end of the sleeve element 21 and a circlip fixedly mounted on the drive shaft 15 at a position adjacent to the front end of the cylinder block 10. The coil spring 25 constantly urges the rotary swash plate 20 against the end of the rotor element 18 so that the non-rotatable wobble plate 23 supported on the rotatable swash plate 20 is held at a position of its maximum angle of inclination at the start of the compressing operation of the reciprocating refrigerant compressor 1.

When the swash plate 20 and the wobble plate 23 are moved to a position adjacent to the circlip via the sliding of the sleeve element 21 while contracting the coil spring 25, the two plates 20 and 23 are turned about the pivots 21*a*, 21*a* by the help of the hinge mechanism 19 to take a minimum angle of inclination thereof.

The rear housing 13 has formed therein a central discharge chamber 26, and a suction chamber 27 extending around the discharge chamber 26. The discharge chamber 26 communicates with a plurality of compression chambers which are defined within the respective cylinder bores 10*a* between the head of the respective piston 16 and the end face of the cylinder block 10, via a plurality of discharge ports 12*a* bored in the valve plate 12 as shown in FIG. 2.

Figure 2:
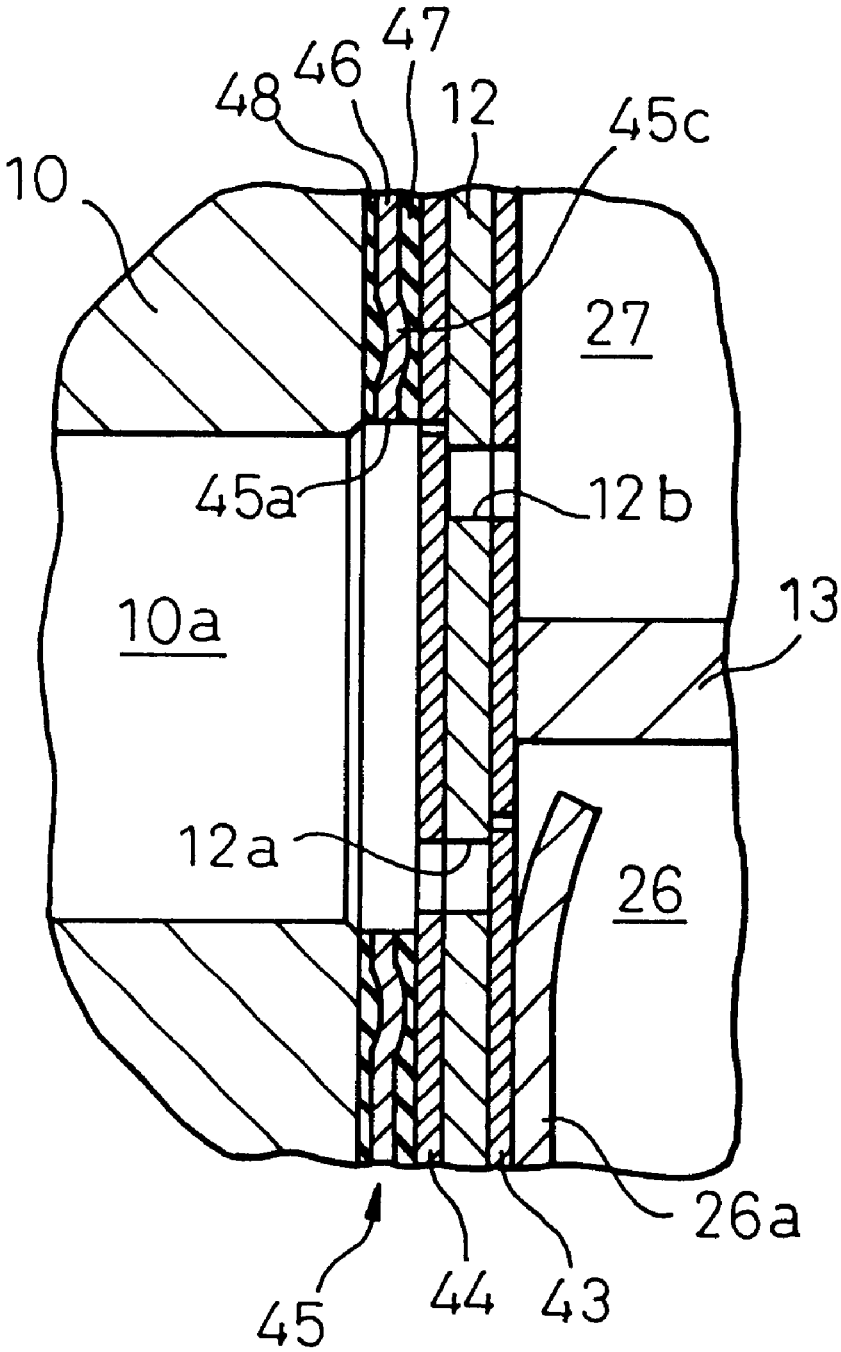
FIG. 2 is an enlarged partial cross-sectional view of the compressor of FIG. 1, illustrating an arrangement of the sealing unit around one of bore ends of the cylinder bores.

As best shown in FIG. 2, each of the discharge ports 12*a* is openably closed by a discharge valve 43 which is attached to one of the opposite faces of the valve plate 12 on the side facing the rear housing 13 and is movable from its port-closing position to its port-opening position where it bears against a valve retainer 26*a* arranged in the discharge chamber 26.

Further, as shown also in FIG. 2, each of the above-mentioned compression chambers within the cylinder bores 10*a* communicates with the suction chamber 27 via a corresponding suction port 12*b* bored in the valve plate 12. The suction port 12*b* is openably closed by each of a plurality of suction valves 44 attached to the face of the valve plate 12 opposite to the face to which the discharge valve 43 is attached.

It should be noted that the suction chamber 27 of the rear housing 13 is fluidly connectable to an accumulator disposed in an external refrigerating circuit of a supercritical-cycle-type refrigerating system via a fluid conduit or pipe, and that the discharge chamber 26 of the rear housing 13 is fluidly connectable to a gas cooler disposed in the refrigerating circuit of the supercritical-cycle-type refrigerating system via another fluid conduit or pipe.

In FIG. 1, a fluid withdrawing passage 28 is formed through the rear housing 13, the valve plate 12, and the cylinder block 10 so as to provide a fluid communication between the crank chamber 14 and the suction chamber 27. Also, a fluid supply passage 29 is formed through the rear housing 13, the valve plate 12, and the cylinder block 10 so as to provide a fluid communication between the crank chamber 14 and the discharge chamber 26. The fluid supply passage 29 is provided as a control passage for controlling a pressure condition within the crank chamber 14, and has a displacement control valve unit 30 arranged therein at an appropriate position in the rear housing 13.

The displacement control valve unit 30 for controlling a compressor displacement has a suction pressure chamber 31 and a discharge pressure chamber 32 formed to oppose to one another along an axis. The suction pressure chamber 31 communicates with the suction chamber 27 via a passage 33 formed in the rear housing 13, and the discharge pressure chamber 32 communicates with the discharge chamber 26 via a passage 34 formed in the rear housing 13. The displacement control valve unit 30 also has a bellows element 36 centrally arranged in the suction pressure chamber 31 so as to enclose an atmospheric pressure chamber 35. The bellows element 36 is constructed so as to expand and contract in a direction along the axis of the displacement control valve unit 30, and is constantly urged by an internal spring element 37 toward its expanded position where an inner end of the bellows element 36 comes close to the discharge pressure chamber 32. The displacement control valve unit 30 further has a valve port 38 formed in a wall defining the discharge pressure chamber 32 at a position facing the suction pressure chamber 31, and a port portion 39 arranged adjacent to the valve port 38. The port portion 39 communicates with the crank chamber 14 via a fluid supply passage 29. The end of the bellows element 36 is connected to an end of a valve rod 40 which extends through an axial bore formed between the suction pressure chamber 31 and the discharge pressure chamber 32 and through the port portion 39 and the valve port 38 into the discharge chamber 32. Namely, an extreme end of the valve rod 40 is attached to a valve element 41 which is arranged to confront the valve port 38, so that the valve element 41 may open and close the valve port 38 in response to an axial movement of the valve rod 40 caused by the expansion and contraction of the bellows element 36 in the suction pressure chamber 31. However, the valve element 41 is constantly urged to its closing position to close the valve port 38 by a spring force of a spring element 42 disposed in the discharge pressure chamber 32. Therefore, when the suction pressure prevailing in the suction pressure chamber 31 of the displacement control valve unit 30 through the passage 33 goes below a preset value, the bellows element 36 expands due to the spring force of the inner spring element 37 so as to axially move the valve rod 40 to thereby move the valve element 41 away from its closing position closing the valve port 38. Accordingly, the refrigerant at a high pressure is supplied from the discharge chamber 26 into the crank chamber 14 via the opened valve port 38 and the port portion 39. Thus, the pressure prevailing in the crank chamber 14 is increased. Nevertheless, the refrigerant in the crank chamber 14 is constantly withdrawn through the fluid withdrawing passage 28 into the suction chamber 27. Therefore, when the suction pressure in the suction pressure chamber 31 goes above the preset value, the bellows element 36 is contracted against the spring force of the inner spring element 37 to draw the valve rod 40. As a result, the valve element 41 is moved back to the closing position thereof closing the valve port 38. Thus, the supply of the refrigerant at a high pressure from the discharge chamber 26 into the crank chamber 14 is stopped. Therefore, the pressure prevailing in the crank chamber 14 is reduced.

In the reciprocating refrigerant compressor 1, the rotation of the drive shaft 15 driven by the external drive power source is converted into a wobbling motion of the non-rotatable wobble plate 23 via the rotary swash plate 20. Thus, the pistons 16 are reciprocated in the corresponding cylinder bores 10*a* to compress the refrigerant sucked from the suction chamber 27 into the cylinder bores 10*a* within the compression chambers therein and to subsequently discharge the compressed refrigerant from the compression chambers into the discharge chamber 26. During the compressing and discharging operation of the compressor, the pressure in the crank chamber 14 is controlled by the displacement control valve unit 30 in response to a change in the suction pressure directly related to a refrigerating load applied by the refrigerating system. Therefore, the reciprocating stroke of the respective pistons 16 and the angle of inclination of the wobble plate 23 are changed in response to a differential between the pressure in the crank chamber 14 acting on the back side of the respective pistons 16 and the pressure acting on the front side of the pistons 16. As a result, the discharge amount of the compressor is adjustably changed, i.e., the controlling of the displacement of the compressor is carried out.

As shown in FIG. 2, the reciprocating refrigerant compressor 1 of the present invention is provided with a sealing unit (a gasket) 45 held in a boundary between the rear end face of the cylinder block 10 and one of the faces of the suction valve 44.

Figure 3:
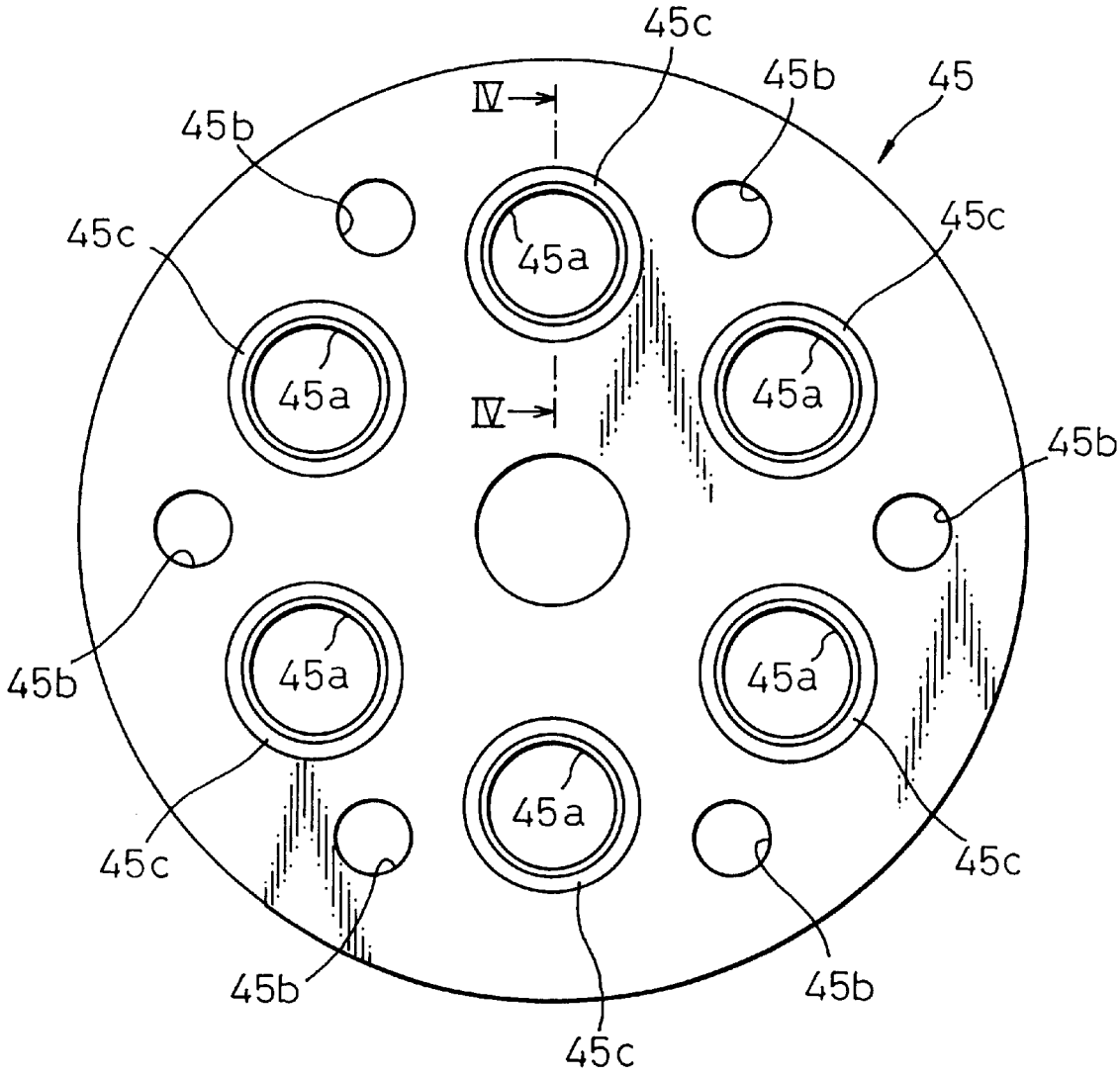
FIG. 3 is a plan view of the sealing unit incorporated in the compressor of the first embodiment of the present invention.
Figure 4:
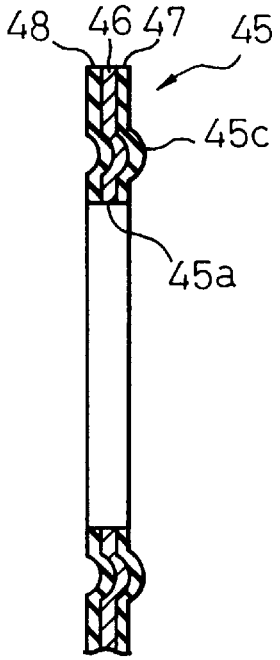
FIG. 4 is a cross-sectional view taken along the line IV—IV of FIG. 3, illustrating the construction of the sealing.

FIGS. 3 and 4 illustrate a detailed construction of the sealing unit 45 according to a first embodiment of the present invention.

Referring to FIGS. 3 and 4, the sealing unit 45 in the state before it is assembled into the interface between the cylinder block 10 and the suction valve 44 is formed as a generally circular unit which includes a circular metallic base plate 46 having opposite faces, and a pair of elastic rubber membranes 47 and 48 attached to the opposite faces of the metallic base plate 46. The sealing unit 45 is provided with a plurality of (six) through bores 45*a* formed therein and arranged at positions in registration with the respective bore ends of the cylinder bores 10*a* of the cylinder block 10. Each of the through bores 45*a* has a diameter approximately corresponding to that of the respective cylinder bores 10*a*. The sealing unit 45 is also provided with a plurality of (six) through bores 45*b* each of which is arranged between the two neighboring through bores 45*a* and is located at a position slightly radially outside compared with the through bores 45*a* as shown in FIG. 3. The through bores 45*b* are provided for permitting through-screw bolts (one of the bolts is shown in FIG. 1) to pass therethrough when the screw bolts are threadedly engaged to tightly combine the cylinder block 10 and the front and rear housings 11 and 13 during assembling of the refrigerant compressor 1.

The metallic base plate 46 and the rubber membranes 47, 48 of the sealing unit 45 are provided with annular beads 45*c* formed around the respective through bores 45*a*. Each of the annular beads 45*c* is formed as an annularly extending convexo-concave portion surrounding each through-bore 45*a*, and is produced by the conventional method of press machining using suitable dies. When the sealing unit 45 is assembled in the boundary between the cylinder block 10 and the suction valve 44, the annular beads 45*a* are arranged so that the convex portion of each bead 45*c* is in contact with either the suction valve 44 or the end face of the cylinder block 10. Each of the annular beads 45*c* of the sealing unit 45 is formed to initially have approximately 0.2 mm height and 2 mm width before the sealing unit 45 is assembled in the compressor and held between the cylinder block 10 and the suction valve 44. Thus, when the sealing unit 45 is assembled in the boundary between the cylinder block 10 and the suction valve 44 and is compressed due to the combining of the cylinder block 10, the front housing 11, the valve plate 12, and the rear housing 13, the convex portions of the respective annular beads 45*c* are brought into press-contact with the confronting surface of the suction valve 44 or the cylinder block 10 causing a small amount crushing. Therefore, the rubber membrane 47 covering the respective annular beads 45*c* is tightly compressed by the metallic base plate 46 and the contacting face, i.e., the suction valve face or the cylinder block face, so that a sealing effect is applied around the respective bore ends of the cylinder bores 10*a* of the cylinder block 10. Accordingly, the compression chambers of the cylinder bores 10*a* a fluidly communicate with only either the discharge chamber 26 or the suction chamber 27 in response to the opening of the discharge valve 43 or the suction valve 44 during the operation of the compressor 1.

When the drive power from an external drive power source, such as a vehicle engine, is applied to the drive shaft 15 via the solenoid clutch, the rotation of the drive shaft 15 causes the rotation of the rotor element 18 together with the rotary swash plate 20 which is held to have a given amount of inclination angle. Therefore, the non-rotatable wobble plate 23 supported on the swash plate via the thrust bearing 22 at the same amount of inclination angle carries out the wobbling motion about the axis of rotation of the drive shaft 15, and accordingly, the respective pistons 16 are reciprocated in the corresponding cylinder bores 10*a* via the connecting rods 24. Therefore, the reciprocation of the respective pistons 16 introduces the refrigerant from the suction chamber 27 into the cylinder bores 10*a* and compresses the refrigerant within the compression chambers within the cylinder bores 10*a*. The compressed refrigerant is discharged by the pistons 16 from the compression chambers of the respective cylinder bores 10*a* into the discharge chamber 26.

When the compressor 1 is incorporated in a supercritical-cycle-type refrigerating system employing carbon dioxide ($CO_2$) as the refrigerant, the compressor 1 compresses the carbon dioxide up to a supercritical pressure of the carbon dioxide, i.e., approximately 10 MPa, and discharges it to the discharge chamber 26 where the carbon dioxide gas at the supercritical pressure is delivered to the refrigerating system. When the refrigerant ($CO_2$) at the supercritical pressure is discharged from the cylinder bores 10*a* into the discharge chamber 26, the high supercritical pressure acts around the bore ends of the respective cylinder bores 10*a*. Nevertheless, the sealing unit 45 having the annular beads 45*c* covered with the elastic rubber membranes 47 and 48 surely maintains the sealing effect around the bore ends to direct the discharged refrigerant only into the discharge chamber 26 without any leakage to a suction pressure region within the compressor 1 or to the exterior of the compressor 1. Therefore, it will be understood that due to the provision of the sealing unit 45, the compressor 1 is allowed to compress a refrigerant up to a supercritical pressure and to be incorporated in a supercritical-cycle-type refrigerating system without causing a reduction in the compressing performance thereof.

(The Second Embodiment)

Figure 5:
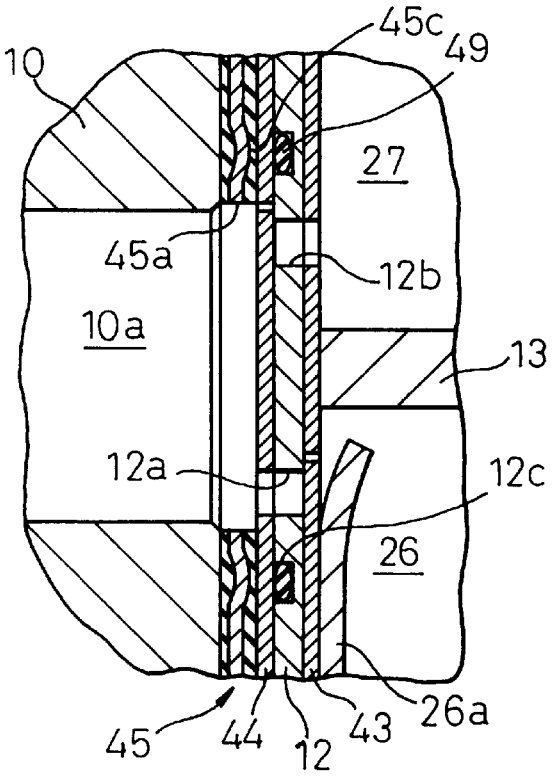
FIG. 5 is a view similar to FIG. 2, but illustrating a sealing unit incorporated in a refrigerant compressor according to a second embodiment of the present invention.

FIG. 5 illustrates a critical part of a reciprocating refrigerant compressor provided with an internal packing unit, according to a second embodiment of the present invention.

The packing unit assembled in the refrigerant compressor of the second embodiment includes a sealing unit 45 similar to the device 45 of the aforementioned embodiment and an additional annular sealing element consisting of a plurality of O-rings 49. Namely, the sealing unit 45 is held tightly between the end face of the cylinder block 10 and one face of the suction valve 44, and the O-rings 49 are held between the opposite face of the suction valve 44 and the valve plate 12. These O-rings 49 are inserted between the suction valve 44 and the valve plate 12 so as to surround the respective bore ends of the cylinder bores 10*a* and are fitted in annular grooves 12*c* recessed in the valve plate 12.

When the compressor is assembled, the sealing unit 45 and the O-rings 49 are compressed by the end face of the cylinder block 10 and the valve plate 12 via the suction valve 44, so that the annular beads 45*c* and the O-rings 49 are fluid-tightly held to apply a complete annular sealing around the respective bore ends of the cylinder bores 10*a*. Particularly, the O-rings 49 can ensure the annular sealing of the respective bore ends of the cylinder bores 10*a* in the boundary between the suction valve 44 and the valve plate 12, and accordingly, a high pressure refrigerant prevented by the sealing unit 45 from leaking is additionally prevented from leaking to a suction pressure region or to the exterior of the compressor through the boundary between the suction valve 44 and the valve plate 12. Consequently, a reduction in the compressing performance of the refrigerant compressor according to the second embodiment can be effectively prevented by the packing unit (a combination of the sealing unit 45 and the O-rings 49).

It should be noted that the construction of the compressor other than the arrangement of the above-mentioned packing unit is the same as that of the first embodiment shown in FIG. 1.

(The Third Embodiment)

Figure 6:
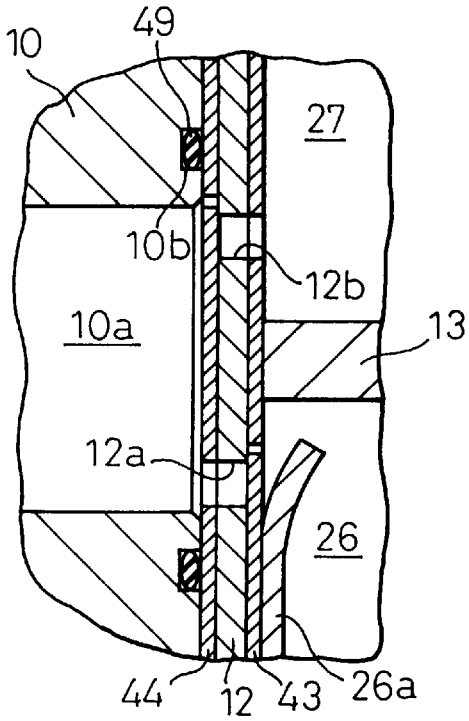
FIG. 6 is a view similar to FIG. 2, but illustrating a sealing unit incorporated in a refrigerant compressor according to a third embodiment of the present invention.

FIG. 6 illustrates a reciprocating type refrigerant compressor provided with a simpler sealing unit according to the third embodiment. Namely, the sealing unit of the present embodiment is comprised of a plurality of O-rings 49 for gas-tightly sealing the bore ends of the respective cylinder bores 10*a* of the cylinder block 10. The O-rings 49 are arranged between the end face of the cylinder block 10 and the confronting face of the suction valve 44 so as to surround the bore ends of the respective cylinder bores 10*a* , and more specifically, the O-rings 49 are fitted in annular grooves 10*b* recessed in the end face of the cylinder block 10. The O-rings 49 are compressed by the cylinder block 10 and the valve plate 12 in the boundary between the end face of the cylinder block 10 and the valve plate 12 via the suction valve 44 to form respective annularly extending sealing portions, and accordingly, the sealing around the bore ends of the respective cylinder bores 10*a* is ensured to prevent leakage of the refrigerant at a high pressure to regions other than the discharge chamber 26. Consequently, a reduction in the compressing performance of the compressor of the third embodiment can be effectively prevented.

It should be noted that the general construction of the compressor of the third embodiment other than the arrangement of the above-mentioned O-ring type sealing unit is the same as that of the first embodiment shown in FIG. 1.

(The Fourth Embodiment)

Figure 7:
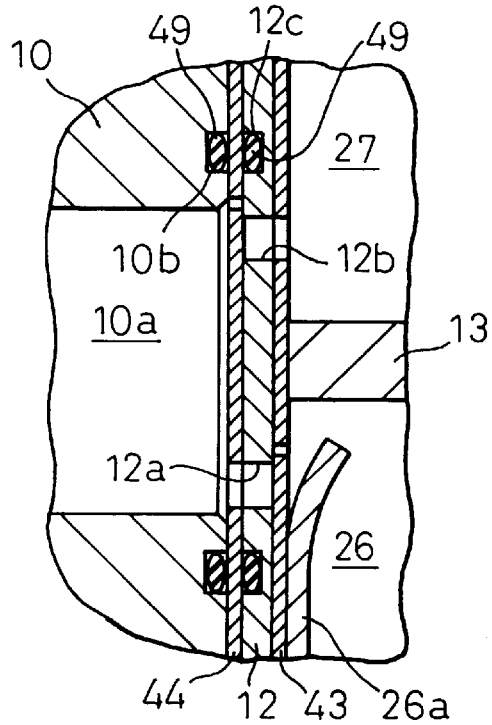
FIG. 7 is a view similar to FIG. 2, but illustrating a sealing unit incorporated in a refrigerant compressor according to a fourth embodiment of the present invention.

FIG. 7 illustrates a critical portion of a refrigerant compressor according to the fourth embodiment, in which an annular sealing unit includes a pair of O-rings 49, 49 arranged around the bore end of each cylinder bore 10*a* of the cylinder block 10. More specifically, in the annular sealing unit of the fourth embodiment, one of the pair of O-rings 49 is interposed in a boundary between the end face of the cylinder block 10 and one of the opposite surfaces of the suction valve 44 to surround the bore end of the cylinder bore 10*a* , and the other of the pair of O-rings 49 is interposed in another boundary between the other of the opposite surfaces of the suction valve 44 and the valve plate 12 to surround the same bore end. At this stage, the pair of O-rings 49, 49 is fitted in annular grooves 10*b*, 12*c* formed in the end face of the cylinder block 10 and formed in an end face of the valve plate 12.

It should be noted that the pair of O-rings 49, 49 arranged around the bore end of each cylinder bore 10*a* are compressed by the cylinder block 10 and the valve plate 12 via the suction valve 44 to apply double annular sealing around the bore end of each cylinder bore 10*a* . Therefore, due to the double annular sealing arranged around the bore ends of the respective cylinder bores 10*a* of the cylinder block 10, leakage of the refrigerant compressed up to a supercritical pressure thereof from the cylinder bores 10*a* to regions other than the discharge chamber 26 can be surely prevented. Accordingly, a reduction in the compressing performance due to the leakage of the high pressure refrigerant through an area surrounding the bore ends of the respective cylinder bores 10*a* can be surely prevented.

Although the several preferred embodiments of the present invention have been described with reference to the case where the refrigerant compressor is incorporated in a supercritical-cycle-type refrigerating system in which the refrigerant at a supercritical is discharged from the compressor, the present invention may be equally applicable to a compressor incorporated in a subcritical-cycle-type refrigerating system.

Further, many changes and modifications to the described embodiments may be effected within the scope and spirit of the present invention as claimed in the accompanying claims.

What we claim:

1. A reciprocating refrigerant compressor comprising:

a cylinder block having formed therein a plurality of cylinder bores arranged to be parallel with one another around an axis extending between opposite ends of said cylinder block;

a valve plate arranged adjacent to said cylinder block and having bored therein a plurality of suction ports and a plurality of discharge ports which are respectively positioned to be in registration with said cylinder bores;

a housing assembly assembled to said cylinder block to close the opposite ends of said cylinder block and defining a suction chamber, a discharge chamber, and a crank chamber;

a suction valve interposed between one of the opposite ends of said cylinder block and said valve plate;

a discharge valve interposed between said valve plate and an end of said housing assembly;

a plurality of pistons arranged to be reciprocated in said plurality of cylinder bores for the compression of a refrigerant sucked from said suction chamber and for the discharge of the compressed refrigerant into said discharge chamber;

a sealing unit held in at least one of boundaries between one of the opposite ends of said cylinder block and said suction valve and between said suction valve and said valve plate, said sealing unit comprising a plurality of annularly extending sealing portions arranged to surround respective bore ends of said plurality of cylinder bores.

2. A reciprocating refrigerant compressor according to claim 1, wherein said sealing unit comprises a metallic base plate having opposite faces thereof, and a gasket element formed by elastic rubber membranes attached to the opposite faces of said metallic base plate, said metallic base plate having a plurality of annularly extending convexo-concave portions in the form of an annular bead portion, respectively, which form said plurality of annularly extending sealing portions.

3. A reciprocating refrigerant compressor according to claim 2, wherein said sealing unit further comprises a plurality of O-ring elements held in the other of the boundaries between one of the opposite ends of said cylinder block and said suction valve and between said suction valve and said valve plate, said plurality of O-rings being arranged to surround said respective bore ends of said plurality of cylinder bores.

4. A reciprocating refrigerant compressor according to claim 2, wherein said plurality of annularly extending convexo-concave portions of said metallic base plate are formed to have substantially 2 mm width and substantially 0.2 mm heights before said sealing unit is assembled in said compressor.

5. A reciprocating refrigerant compressor according to claim 1, wherein said sealing unit comprises a plurality of O-ring elements arranged around each of said respective bore ends of said plurality of cylinder bores.

6. A reciprocating refrigerant compressor according to claim 5, wherein said plurality of O-rings are held in both of the boundaries between one of the opposite ends of said cylinder block and said suction valve and between said suction valve and said valve plate.

7. A reciprocating refrigerant compressor according to claim 6, wherein said plurality of O-rings held in the boundary between said one of the opposite ends of said cylinder block are received in annular recesses formed in said end of said cylinder block, and said plurality of O-rings held in the boundary between said suction valve and said valve plate are received in annular recesses formed in said valve plate.

8. A reciprocating refrigerant compressor according to claim 1, wherein said reciprocating refrigerant compressor discharges the refrigerant by compressing it to a supercritical pressure.

9. A reciprocating refrigerant compressor according to claim 8, wherein said refrigerant is comprised of carbon dioxide.

* * * * *